United States Patent [19]

Takahashi et al.

[11] 4,410,372

[45] Oct. 18, 1983

[54] PROCESS FOR PRODUCING DEEP-DRAWING, NON-AGEING, COLD ROLLED STEEL STRIPS HAVING EXCELLENT PAINT BAKE-HARDENABILITY BY CONTINUOUS ANNEALING

[75] Inventors: Nobuyuki Takahashi; Masaaki Shibata; Yoshikuni Furuno, all of Kitakyushu, Japan

[73] Assignee: Nippon Steel Corporation, Tokyo, Japan

[21] Appl. No.: 386,095

[22] Filed: Jun. 7, 1982

[30] Foreign Application Priority Data

Jun. 10, 1981 [JP] Japan ..... 56-89142
Sep. 18, 1981 [JP] Japan ..... 56-147589

[51] Int. Cl.[3] ..... C21D 8/04

[52] U.S. Cl. ..... 148/12 C; 148/12 D; 148/12.4; 148/144

[58] Field of Search ..... 148/12 C, 36, 12 D, 148/12.4, 144

[56] References Cited

U.S. PATENT DOCUMENTS 3,725,143 4/1973 Alworth et al. ..... 148/36
3,950,191 4/1976 Ito et al. ..... 148/36
3,988,173 10/1976 Kawano ..... 148/36
4,315,783 2/1982 Akisue et al. ..... 148/12 C
4,331,488 5/1982 Sudo et al. ..... 148/36

FOREIGN PATENT DOCUMENTS 55-89430 7/1980 Japan ..... 148/12 C
55-94446 7/1980 Japan ..... 148/12 C
55-145123 11/1980 Japan ..... 148/12 C

*Primary Examiner*—Peter K. Skiff
*Attorney, Agent, or Firm*—Cushman, Darby & Cushman

[57] ABSTRACT

Al-killed steels containing 0.001–0.01% C., not larger than 1.5% Mn, 0.005–0.20% Al, not larger than 0.007% N and B in amounts determined by the ratio of B/N ranging from 0.5 to 2.5, and optionally containing not less than 1% Si and 0.04 to 0.12% P are subjected to ordinary hot and cold rolling operations, then soaked in a temperature range of from 730° C. to $A_3$ point by a continuous annealing process, and rapidly cooled from a temperature between the soaking temperature to 450° C. down to a temperature not higher than 250° C. at an average cooling rate not less than 60° C./second, without subsequent overageing treatments, to obtain deep-drawing, non-ageing cold rolled steel sheets and strips having excellent press formability and paint bake-hardenability.

10 Claims, No Drawings

PROCESS FOR PRODUCING DEEP-DRAWING, NON-AGEING, COLD ROLLED STEEL STRIPS HAVING EXCELLENT PAINT BAKE-HARDENABILITY BY CONTINUOUS ANNEALING

BACKGROUND OF THE INVENTION

1. Field of the Invention

The present invention relates to processes for producing deep-drawing, non-ageing cold rolled steel sheets having excellent press formability and paint bake-hardenability.

2. Description of the Prior Art

Press-forming cold rolled steel sheets and strips (hereinafter called "strips") used in automobile cars are required to have excellent deep-drawability, stretchability, shape quality and non-ageing property, and these requirements are particularly important for use in the outer skin applications, such as doors, roofs and quater pannels.

Moreover in recent years, for the purpose of obtaining a high dent-resistance of pannels due to the car vibration, increasing demands have been made on the strips for an additional property, called "paint bake-hardenability" that the yield point of the steel strips can rise remarkably during the heat treatment for paint baking on the steel strips in the automobile car production.

Cold rolled steel strips having such paint bake-hardenability are known, as disclosed in Japanese Patent Application Laid-Open No. Sho 54-107419, according to which Al-killed steels are subjected to hot and cold rollings, then subjected to an open coil annealing wherein the strips are soaked at a temperature ranging from $A_1$ point to $A_3$ point, and cooled at a cooling rate of 30° to 200° C./hour, or Al-killed steels having a lowered carbon content of about 0.01% are subjected to a tight-coil box-type annealing so as to increase the solid solution carbon. However, the paint bake-hardening degree obtained by this prior art is still far below 5 kg/mm$^2$ which is an ordinary standard for the purpose. Moreover, the annealing in the prior art is done by the box-type annealing process which comprises slow cooling, long-time soaking, and slow cooling, so that a considerably long time is required, thus causing problems with respect to the productivity.

Meanwhile, several proposals have been made as disclosed in Japanese Patent Publications No. Sho 47-33409 and No. Sho 49-1969 for production of cold rolled steel strips having an excellent press formability, such as deep-drawing and stretchability, and their production has limitedly been made on a commercial scale.

However, according to these prior arts, it is essential to heat and soak the steel in a continuous annealing furnace, then rapidly cool the steel to about 400° C., for example, and overage the steel near this temperature, or to cool the steel to the room temperature, then reheat the steel to about 400° C. and overage the steel near this temperature.

These conventional cold rolled steel strips obtained by continuous annealing have a problem that the yield point elongation appears so far as they are in "as non-skinpassed state", namely they are ageing, even if they have been overaged, or even if they have lowered C and N contents and contain additional elements, such as Al and B.

Therefore, these prior arts cannot satisfactorily produce a deep-drawing, non-ageing, cold rolled steel strip having an excellent paint bake-hardenability as desired by the present invention.

Also according to the conventional continuous annealing process, it is essential to perform the overageing treatment as mentioned before in order to reduce the solute C and N, so that the production cycle can be shortened only limitedly and the continuous annealing line must be considerably long.

SUMMARY OF THE INVENTION

Therefore, one of the objects of the present invention is to provide a process for producing deep-drawing, non-ageing cold rolled steel strips having excellent press formability and paint bake-hardenability, and the present inventors have been extensive studies for this object, particularly with respect to the steel composition and the continuous annealing cycle and have found that the above object can be achieved by soaking B-containing Al-killed steels with a lowered carbon content ranging from 0.001 to 0.010% in a temperature range of from 730° C. to $Ar_3$ point in a continuous annealing process and then rapidly cooling the steels from a temperature between the soaking temperature and 450° C.

The process according to the present invention comprises hot and cold rolling a steel containing 0.001 to 0.01% C, not larger than 1.5% Mn, 0.005 to 0.20% Al, not larger than 0.007% N and B in an amount determined by the ratio of B/N ranging from 0.5 to 2.5, and optionally containing not larger than 1.0% Si and 0.04 to 0.12% P in an ordinary way, then soaking the strip thus obtained in a temperature range of from 730° C. to $A_3$ point by continuous annealing, and rapidly cooling the strip from a temperature between the soaking temperature and 450° C. to a temperature not higher than 250° C. at an average cooling rate not less than 60° C./second without a subsequent overageing treatment.

The present invention has been completed after various extensive tries and studies for the purpose of meeting with apparently contradictory demands to provide a very small degree of ageing property and at the same time excellent paint bake-hardening property.

The steel strips obtained by the present invention can restrict the occurrence of yield point elongation in the as-annealed condition prior to skinpass rolling and are less ageing but have an excellent paint bake-hardening property, and further can maintain these excellent qualities even after they are subjected to skin-pass rolling or levelling for shape correction and surface roughness adjustment.

The non-ageing quality desired and obtainable by the present invention means such that the occurrence of the yield point elongation (YPEL) of the strip after artificial ageing at 100° C. for 30 minutes is not more than 0.3%.

No theoretical clarification has not yet been made why the excellent properties of the strips according to the present invention can be obtained, but most probably they are related to the grain boundary strength and the behaviour of the solid solution carbon.

Generally speaking, the production of cold rolled steel strips by continuous annealing requires a cycle comprising short-time heat treatments, namely a rapid heating, a short-time heat treatment and a rapid cooling, so that the carbon in the steel remains in an oversaturated state. Therefore, it is a common practice to perform an overageing treatment in order to provide non-ageing quality or to soften the steel.

In this case, it has been proposed that the steel is exceedingly rapidly cooled directly from the soaking temperature or from a relatively high temperature zone during the slow cooling so as to intentionally increase the over-saturated solid solution carbon, and then precipitation of the carbon is promoted by a subsequent overageing treatment. The present invention is based on a technical thought completely different from the prior art and does not require the overageing treatment. Contrary to the prior art, the overageing treatment is rather harmful in the present invention because it tends to increase the yield point elongation in the as-annealed condition as mentioned hereinbefore and increase the ageing degree, thus failing to achieve the objects of the present invention.

Meanwhile, dual-phase cold rolled steel strips are known as a steel strip similar to the steel strip according to the present invention, which are produced by continuous annealing without an overageing treatment and are restricted in the occurrence of yield point elongation in the as-annealed conditions prior to skinpass rolling and show less ageing and an excellent paint bake-hardening property. However, these dual-phase cold rolled steel strips have the mixed structures of ferrite and martensite which is transformed during rapid cooling from the $\alpha$-$\gamma$ temperature region, while the steel structure produced by the present invention consists of ferrite as cooled rapidly from mainly the $\alpha$ single phase condition.

Therefore, the steep strips according to the present invention are completely different from the dual-phase steel strips with respect to the metallography as well as the steel composition and the resultant strength level.

DETAILED DESCRIPTION OF THE INVENTION

The present invention will be described in more details hereinbelow.

The essential features of the present invention and various limitations made in the present invention will be explained.

Regarding the chemical composition of the steel strips according to the present invention, carbon is one of the most important elements and must be limited to the range of from 0.001 to 0.01% in order to restrict the occurrence of yield point elongation in the as-annealed condition when the steel is rapidly cooled from a temperature between the soaking temperature and 450° C. and to provide less ageing and excellent paint bake-hardening property.

When the carbon content is less than 0.001%, no enough paint bake-hardening can be obtained, but when it exceeds 0.010% a significant yield point elongation develops under the as-annealed condition, and the ageing property increases and the elongation greatly deteriorates. A preferable carbon range is from 0.002 to 0.006%.

Manganese is essential for preventing the hot embrittlement of the steel, but excessive manganese contents will produce excessive hardness of the steel. Therefore, in the present invention, the upper limit of the manganese content is 1.5%, and the manganese may be contained in various amounts within the defined range depending on the desired strength of the products. For example, when low strength deep-drawing cold rolled steel strips are desired the manganese content is maintained at about 0.6% or less, and for special applications it may be maintained less than about 0.3%. Naturally larger manganese contents are maintained for obtaining high strength steel sheets.

Aluminum must be contained in amounts not less than 0.005% as soluble aluminum for desired deoxidation of the steel, but aluminum contents of 0.2% or larger will very often cause surface defects. Therefore, the aluminum content should be desirably maintained not more than 0.06%.

Nitrogen, when contained in excessive amounts, is harmful to the object of the present invention to restrict the occurrence of yield point elongation in the as-annealed condition and assure less ageing. In the present invention, the nitrogen contents within the defined range are combined with boron to form BN, thus rendering the nitrogen content harmless. However, excessive nitrogen contents will necessitate considerable wasteful consumption of ferro-boron alloy. Therefore, the upper limit of the nitrogen content in the present invention is 0.007%, and preferably 0.004%.

Boron is one of the important features of the present invention, and in order to eliminate the harm of the nitrogen content, the boron content must be in amounts equivalent to the B/N ratio (weight %) of 0.5 or larger. On the other hand, if the B/N ratio exceeds 2.5, boron in solid solution will harden the steel. A preferable range of the B/N ratio is from 0.7 to 1.0.

Within the scope of the present invention, silicon and phosphorus are additionally contained when a higher strength level of the products is required.

Silicon is effective for strengthening the steel, but excessive silicon contents will tend to cause deterioration of the corrosion resistance of the steel after paint coating. Therefore, the upper limit of the silicon content in the present invention is 1.0%.

In this connection, it should be noted that in conventionally known Al-killed steels, when Si and Mn are contained and extra rapid cooling is performed, remarkable temper colors develop so that Si and Mn are limited to very small contents, while in the present invention, Si and Mn contents can be increased without danger of temper color development due to a secondary effect of the limitation of the carbon content to 0.01% or less. This is a significant advantage of the present invention.

Phosphorus is most effective to strengthen the steel and at least 0.004% phorphorus is required for this purpose.

Excessive phosphorus contents will deteriorate weldability of the steel and the upper limit should be placed at 0.12%. It is worthy to note that satisfactory non-embrittled fracture during press stamping which is the most important concern when phosphorus is contained in extra-low carbon Al-killed steels can be maintained.

With the above steel composition in combination with the effects of the continuous annealing process details of which will be described hereinbelow, non-ageing steel strips having excellent press formability with respect to deep-drawability and stretchability in particular and excellent paint bake-hardening property can be produced.

Now according to the present invention, no special limitations are imposed on the hot and cold rolling operations. However, in the hot rolling operation, it is desirable to maintain the finishing temperature not lower than $Ar_3$ point and the cooling temperature not higher than 650° C. for the desired deep-drawability. Meanwhile, in the cold rolling operation, a rolling reduction rate not less than 75% is desirable.

In the present invention, the continuous annealing conditions after the cold rolling step are most important.

The reasons for soaking the steel in the temperature range of from 730° C. to $A_3$ point in the continuous annealing process are that when the soaking temperature is too low, only incomplete grain growth can be produced, which is considered to be hinderous to the restriction of occurrence of yield point elongation in the as-annealed condition and the less ageing property, and the deep-drawability is deteriorated by the too low soaking temperature. On the other hand, when the soaking temperature exceeds $Ar_3$ point, the deep-drawability is again extremely damaged. A preferable soaking temperature range is from 750° C. to 850° C. Regarding the soaking time, about 10 to 180 seconds is most practicable, but may be longer or shorter as cases require.

After the soaking, the steel is rapidly cooled from any desired temperature within the range of from the soaking temperature to 450° C. to a temperature not higher than 250° C. at an average cooling rate not less than about 60° C./second. This soaking condition, as well as the carbon content limitation, is one of the most important features of the present invention, and if this condition is not satisfied, it is impossible to restrict the occurrence of yield point elongation in the as-annealed condition prior skinpass rolling and provide the less-ageing property.

Although theoretical clarification of the above phenomenon has not yet been made, it is considered to be related with the the fact that the precipitation of carbon into cementites etc. can be practically prevented by the rapid cooling as defined above.

As described above, the rapid cooling is done directly from the soaking temperature or is started when the steel is slowly cooled to a temperature not lower than 450° C. This slow cooling to 450° C. may be practically performed at a cooling rate of about 10° C./second. Meanwhile, the starting temperature for the rapid cooling should preferably be between 775° C. and 600° C. and the average cooling rate for the rapid cooling should preferably be not lower than 200° C./second.

It is also essential in the present invention to avoid an overageing treatment after the rapid cooling, quite contrary to the conventional arts. Thus in the present invention, when an overageing treatment is done around 400° C., the yield point elongation restores after the annealing and it is difficult to reduce the ageing property even if a temper rolling is performed. However, the conventional continuous annealing apparatus is generally annexed with an overageing furnace after the annealing furnace, so that if it is unavoidable to pass the strip through the overageing furnace, the passage must be made at a temperature not higher than 250° C., for example. Further, in the present invention as the occurrence of yield point elongation in the as-annealed condition is restricted, it is generally unnecessary to perform the temper rolling, but it may be done for shapeness correction and surface roughness adjustment of the strip production. However, it is desirable to perform the temper rolling with a slight reduction so as to avoid lowering of the ductility.

Further within the scope of the present invention, the steel strips may be coated by hot dipping during the cooling step of the continuous annealing but before the rapid cooling so as to obtain surface treated deep-drawing steel strips such as Zn coated and Al coated steel strips which are non-ageing and have an excellent paint bake-hardening property.

The present invention will be more clearly understood from the embodiments described hereinbelow.

EXAMPLE 1

Steels having chemical compositions shown in Table 1 are prepared by means of a converter and a vacuum degassing vessel, continuously cast into slabs, hot rolled into hot coils of 3.0 mm in thickness, with a finishing temperature at 910° C. and a coiling temperature at 625° C., then subjected to descaling and cold rolling into strips of 0.8 mm in thickness, and continuous annealing under the following conditions. The soaking is done at 830° C., and the strips are held at the temperature for 60 seconds, then slowly cooled to 700° C. at an average cooling rate of 10° C./second, and rapidly cooled from this temperature to 200° C. at an average cooling rate of 1000° C./second with or without a subsequent skinpass rolling with reduction rates as shown in the Table 1.

Steel Nos. 1–5 shown in Table 1 are produced according to the present invention are practically non-ageing and show a significantly high level of paint bake-hardening with excellent deep-drawability, while comparative steels Nos. 6 and 7 which are outside the scope of the present invention with respect to the carbon content show substantial occurrence of yield point elongation in the as-annealed condition prior to skinpass rolling, a high degree of ageing, and are considerably inferior to those obtained according to the present invention with respect to the elongation.

Comparative steels Nos. 8 and 9 which are outside the scope of the present invention with respect to the B/N ratio show restricted occurrence of yield point elongation in the as-annealed condition, but show considerably large ageing as compared with the steels according to the present invention.

EXAMPLE 2

This example is intended to illustrate the criticalities of the continuous annealing conditions.

Steels having the same chemical compositions as steel No. 1 and No. 2 in Table 1 are subjected to various soaking temperatures, starting temperatures for the rapid cooling, average cooling rates in the rapid cooling to 250° C. and steel G only was subjected to overageing at 400° C. for 2 minutes.

Steels A to D are within the scope of the present invention and practically non-ageing, and show a high level of paint bake-hardening with excellent deep-drawability.

Steels E and F are outside the scope of the present invention with respect to the average cooling rate in the rapid cooling to 250° C., and steel G is outside the scope of the present invention with respect to the overageing, and steels H and I are outside the scope of the present invention with respect to the starting temperature of the rapid cooling and steels J and K are outside the scope of the present invention with respect to the soaking temperature. All of these comparative steels show a considerable yield point elongation in the as-annealed condition prior to skinpass rolling, and a high degree of ageing, thus unsuitable for applications where the non-ageing property is required.

EXAMPLE 3

Steels having chemical compositions as shown in Table 3 are prepared by means of a converter and a vacuum degassing vessel, continuously cast into slabs, hot rolled into hot coils of 4.0 mm in thickness with a finishing temperature at 910° C. and a coiling temperature at 600° C., then subjected to descaling, cold rolling into strips of 0.8 mm in thickness, and continuous annealing under the following conditions.

The strips are soaked at 800° C. for 60 seconds, and then cooled to 250° C. under the conditions shown in Table 1. The cooling after the soaking to the starting temperature of the rapid cooling is done at a cooling rate of 10° C./sec. The tensile test was performed in the as-annealed condition, and the ageing was evaluated at 100° C. for 30 minutes, but the test pieces which showed yield point elongation in the as-annealed condition were subjected to 0.8% temper rolling reduction and then artificial ageing. The paint bake-hardening was expressed by the increase in yield stress of 2% prestrained specimen after the heat treatment simulated to paint baking at 170° C. for 20 minutes.

The test results are shown in Table 3, from which it is clearly demonstrated that the test pieces No. 1, No. 2, No. 5, No. 8 and No. 9 which are within the scope of the present invention show no yield point elongation in the as-annealed condition and are non-ageing with excellent paint bake-hardenability and deep-drawability as well as high strength.

Meanwhile, the comparative test pieces No. 4 which is outside the scope of the present invention with respect to the starting temperature of the rapid cooling, and No. 6 and No. 7 which are outside the scope of the present invention with respect to the chemical composition show a considerable yield point elongation or a considerably high degree of ageing or further remarkable tendency of embrittlement during stamping, thus failing to suit for outer skin applications of automobile cars.

As clearly understood from the foregoing descriptions, the present invention has significant industrial advantages because it can produce deep-drawing, high strength cold rolled steel strips having excellent paint bake-hardening property by continuous annealing with a very high production efficiency without overageing, and can well meet with the increasing demands of such steel strips.

TABLE 1-1

| Steel No. | Production Process | Chemical Composition C (%) | Si (%) | Mn (%) | P (%) | S (%) | Sol. Al (%) | N (%) | B (%) | B/N |
|---|---|---|---|---|---|---|---|---|---|---|
| 1 | Present Invention | 0.003 | 0.03 | 0.22 | 0.012 | 0.013 | 0.028 | 0.0020 | 0.0032 | 1.60 |
| 2 | Present Invention | " | " | " | " | " | " | " | " | " |
| 3 | Present Invention | 0.005 | 0.05 | 0.34 | 0.007 | 0.008 | 0.054 | 0.0046 | 0.0035 | 0.76 |
| 4 | Present Invention | " | " | " | " | " | " | " | " | " |
| 5 | Present Invention | 0.002 | 0.02 | 0.11 | 0.007 | 0.005 | 0.012 | 0.0015 | 0.0020 | 1.3 |
| 6 | Comparative | 0.012 | 0.01 | 0.26 | 0.010 | 0.012 | 0.073 | 0.0021 | 0.0019 | 0.90 |
| 7 | Comparative | " | " | " | " | " | " | " | " | " |
| 8 | Comparative | 0.004 | 0.03 | 0.11 | 0.015 | 0.011 | 0.069 | 0.0020 | — | 0 |
| 9 | Comparative | " | " | " | " | " | " | " | — | " |

TABLE 1-2

| Steel No. | Production Process | Skinpass Rolling and Reduction Rate | Mechanical Properties: Yield Stress (kg/mm²) | Tensile Strength (kg/mm²) | Elongation (%) | Yield Point Elongation (%) | $\bar{r}$ Value | Increase in Yield Stress due to Ageing (kg/mm²) | Yield Point Elongation after Ageing (%) | Paint bake-hardening (kg/mm²) |
|---|---|---|---|---|---|---|---|---|---|---|
| 1 | Present Invention | None | 18.0 | 29.5 | 5.06 | 0 | 1.8 | 0 | 0.1 | 5.8 |
| 2 | Present Invention | 0.8% | 16.3 | 30.1 | 49.8 | 0 | 1.8 | 0 | 0 | 6.0 |
| 3 | Present Invention | None | 18.4 | 30.4 | 49.7 | 0.1 | 1.7 | 0.2 | 0.1 | 6.0 |
| 4 | Present Invention | 0.4% | 17.1 | 30.7 | 49.2 | 0 | 1.7 | 0.1 | 0 | 6.5 |
| 5 | Present Invention | None | 15.1 | 28.8 | 52.0 | 0 | 2.0 | 0 | 0 | 5.0 |
| 6 | Comparative | None | 21.1 | 33.1 | 43.2 | 2.3 | 1.4 | 1.7 | 2.8 | 5.6 |
| 7 | Comparative | 0.8% | 19.4 | 35.0 | 39.8 | 0 | 1.4 | 4.1 | 1.2 | 5.8 |
| 8 | Comparative | None | 20.8 | 31.3 | 48.2 | 0.1 | 1.6 | 0.8 | 0.6 | 6.2 |
| 9 | Comparative | 0.8% | 19.4 | 32.2 | 47.1 | 0 | 1.6 | 1.2 | 0.4 | 5.9 |

Note:

Ageing Condition: Artificial Ageing at 100° C. for 30 minutes. The paint bake-hardening is expressed by the increase in yield stress by a heat treatment simulated to the paint baking at 170° C. for 20 minutes after 2% prestrain.

TABLE 2-1

| Steel | Production Process | Continuous Annealing Condition: Soaking Temp. × seconds | Starting Temp. of Rapid Cooling | Average Cooling Rate from Start of Rapid Cooling to 250° C. | Skinpass Rolling and Reduction Rate |
|---|---|---|---|---|---|
| A | Present Invention | 830° C. × 60 sec | 700° C. | 1000° C./sec | — |
| B | Present Invention | " | " | " | 0.8% |
| C | Present Invention | " | " | 300° C./sec | — |
| D | Present Invention | " | " | " | 0.8% |
| E | Comparative | " | " | 30° C./sec | — |
| F | Comparative | " | " | " | 0.8% |
| G | Comparative | " | " | 1000° C./sec | — |
| H | Comparative | " | 400° C. | " | — |
| I | Comparative | " | " | " | 0.8% |
| J | Comparative | 700° C. × 60 sec | 700° C. | " | — |
| K | Comparative | " | " | " | 0.8% |

TABLE 2-2

| Steel | Production Process | Mechanical Properties: Yield Stress (kg/mm²) | Tensile Strength (kg/mm²) | Elongation (%) | Yield Point Elongation (%) | $\bar{r}$ Value | Increase in Yield Stress due to Ageing (kg/mm²) | Yield Point Elongation after Ageing (%) | Paint bake-hardening (kg/mm²) |
|---|---|---|---|---|---|---|---|---|---|
| A | Present Invention | 18.0 | 29.5 | 50.6 | 0 | 1.8 | 0 | 0.1 | 5.8 |
| B | Present Invention | 16.3 | 30.1 | 49.8 | 0 | 1.8 | 0 | 0 | 6.0 |
| C | Present Invention | 18.3 | 29.6 | 50.8 | 0 | 1.8 | 0.3 | 0.2 | 6.0 |
| D | Present Invention | 17.0 | 30.1 | 50.2 | 0 | 1.8 | 0 | 0.1 | 5.9 |
| E | Comparative | 20.8 | 29.4 | 50.9 | 4.3 | 1.8 | 0.2 | 4.4 | 5.7 |
| F | Comparative | 17.9 | 30.0 | 48.2 | 0 | 1.8 | 2.0 | 1.2 | 6.1 |
| G | Comparative | 23.3 | 29.2 | 49.0 | 5.2 | 1.8 | 0.6 | 5.5 | 4.8 |
| H | Comparative | 20.6 | 29.4 | 50.7 | 3.9 | 1.8 | 0.3 | 4.0 | 5.6 |
| I | Comparative | 18.0 | 30.1 | 48.6 | 0 | 1.8 | 1.6 | 1.1 | 5.8 |
| J | Comparative | 21.3 | 31.9 | 46.2 | 1.8 | 1.4 | 1.6 | 2.5 | 5.5 |
| K | Comparative | 20.2 | 33.0 | 44.6 | 0 | 1.4 | 0.7 | 1.2 | 5.7 |

Steel G was reheated and overaged at 400° C. for 2 minutes after rapid cooling.

TABLE 3-1

| Steel No. | Chemical Composition (wt %): C | Si | Mn | P | S | Sol. Al | N | B | B/N |
|---|---|---|---|---|---|---|---|---|---|
| ① | 0.003 | 0.03 | 0.23 | 0.065 | 0.010 | 0.030 | 0.0034 | 0.0028 | 0.8 |
| ② | " | " | " | " | " | " | " | " | " |
| 3 | " | " | " | " | " | " | " | " | " |
| 4 | " | " | " | " | " | " | " | " | " |
| ⑤ | 0.005 | 0.32 | 0.89 | 0.085 | 0.012 | 0.036 | 0.0024 | 0.0035 | 1.4 |
| 6 | 0.004 | 0.02 | 0.22 | 0.068 | 0.011 | 0.043 | 0.0032 | — | — |
| 7 | 0.016 | 0.02 | 0.50 | 0.058 | 0.010 | 0.052 | 0.0040 | 0.0035 | 0.9 |
| ⑧ | 0.002 | 0.02 | 1.2 | 0.041 | 0.005 | 0.012 | 0.0018 | 0.0020 | 1.1 |
| ⑨ | 0.004 | 0.81 | 0.14 | 0.046 | 0.007 | 0.009 | 0.0046 | 0.0040 | 0.9 |

○ Present Invention

TABLE 3-2

| Steel No. | Cooling Condition: Starting Temp. of Rapid Cooling (°C.) | Average Cooling Rate from Start of Rapid Cooling to 250° C. (°C./sec) | Mechanical Properties: Yield Stress (kg/mm²) | Tensile Strength (kg/mm²) | Elongation (%) | Yield Point Elongation (%) | $\bar{r}$ Value | Yield Point Elongation after Ageing (%) | Paint bake-hardening (kg/mm²) |
|---|---|---|---|---|---|---|---|---|---|
| ① | 700 | 1000 | 23.4 | 36.4 | 44 | 0 | 1.8 | 0 | 5.5 |
| ② | " | 300 | 23.8 | 36.1 | 45 | 0 | 1.8 | 0.3 | 5.8 |
| 3 | " | 20 | 25.7 | 36.0 | 45 | 4.2 | 1.8 | *1.2 | 5.0 |
| 4 | 400 | 1000 | 25.5 | 36.0 | 45 | 3.6 | 1.8 | *1.0 | 5.1 |
| ⑤ | 700 | " | 27.0 | 41.7 | 39 | 0 | 1.7 | 0 | 6.2 |
| 6 | " | " | 26.1 | 37.6 | 43 | 0.2 | 1.5 | *0.8 | 5.9 |

TABLE 3-2-continued

| Steel No. | Cooling Condition: Starting Temp. of Rapid Cooling (°C.) | Cooling Condition: Average Cooling Rate from Start of Rapid Cooling to 250° C. (°C./sec) | Mechanical Properties: Yield Stress (kg/mm²) | Mechanical Properties: Tensile Strength (kg/mm²) | Mechanical Properties: Elongation (%) | Mechanical Properties: Yield Point Elongation (%) | Mechanical Properties: $\bar{r}$ Value | Yield Point Elongation after Ageing (%) | Paint bake-hardening (kg/mm²) |
|---|---|---|---|---|---|---|---|---|---|
| 7 | " | " | 31.2 | 43.8 | 32 | 2.8 | 1.4 | *1.2 | 5.4 |
| ⑧ | " | " | 25.8 | 39.0 | 44 | 0 | 1.7 | 0 | 5.0 |
| ⑨ | " | " | 30.2 | 43.0 | 38 | 0 | 1.7 | 0 | 5.1 |

Note:
○Present Invention
(1) Ageing Condition: 100° C. for 30 minutes.
*Artificial ageing is done after 0.8% skinpass rolling following the annealing.
(2) The paint bake-hardening is expressed by the increase in yield stress by a heat treatment simulated to the paint baking at 170° C. for 20 minutes after 2% prestrain.

What is claimed is:

1. A process for producing non-ageing, deep-drawing steel strip having excellent paint bake-hardening property by continuous annealing, consisting essentially of without overaging subjecting an Al-killed steel containing 0.001 to 0.01% C, not larger than 1.5% Mn, 0.005 to 0.20% Al, not larger than 0.007% N and B in an amount equivalent to B/N ratio ranging from 0.5 to 2.5 to ordinary hot and cold rolling steps, soaking thus obtained steel strip in a temperature range of from 730° C. to $A_3$ point in a continuous annealing system, and rapidly cooling the strip thus soaked down to a temperature not higher than 250° C., the rapid cooling starting from a temperature ranging from 775° to 600° C. with an average cooling rate not lower than 200° C./second, to produce a strip having an increase in yield stress due to ageing at 100° C. for 30 minutes of not over 0.3 kg/$_{mm}$2.

2. A process according to claim 1, in which the Al-killed steel contains not larger than 1.0% Si and 0.04 to 0.12% P.

3. A process according to claim 1, in which the Al-killed steel contains 0.002 to 0.006% C.

4. A process according to claim 1, in which the Al-killed steel contains 0.1 to 0.6% Mn.

5. A process according to claim 1, in which the Al-killed steel contains 0.005 to 0.06% Al.

6. A process according to claim 1, in which the Al-killed steel contains not larger than 0.004% N.

7. A process according to claim 1, in which the hot rolling is done with a finishing temperature not lower than $Ar_3$ point, and a coiling temperature not higher than 650° C. and the cold rolling is done with a reduction rate not less than 75%.

8. A process according to claim 1, in which the soaking temperature ranges from 750° to 850° C.

9. A process according to claim 1, in which the strip after continuous annealing is subjected to metal coating by hot dipping before the rapid cooling.

10. A process according to claim 1 wherein the steel consists essentially of (a) 0.001 to 0.01% C, Mn, the Mn being present in an amount not over 1.5%, 0.005 to 0.20% Al, N, the N being present in an amount not over 0.007% and B in an amount equivalent to a B/N ratio ranging from 0.5 to 2.5, balance iron or (b) a steel as in (a) but also including Si and P, the amount of Si being not over 1.0% and the P being 0.04 to 0.1%.

* * * * *